US008938852B2

(12) United States Patent
Kim

(10) Patent No.: US 8,938,852 B2
(45) Date of Patent: Jan. 27, 2015

(54) DEVICE FOR CHECKING THE DOOR OF A VEHICLE

(75) Inventor: Seung Tae Kim, Anyang-si (KR)

(73) Assignee: KWANGJIN Co., Ltd. (KR)

( * ) Notice: Subject to any disclaimer, the term of this patent is extended or adjusted under 35 U.S.C. 154(b) by 0 days.

(21) Appl. No.: 14/119,376

(22) PCT Filed: Feb. 8, 2012

(86) PCT No.: PCT/KR2012/000916

§ 371 (c)(1),
(2), (4) Date: Nov. 21, 2013

(87) PCT Pub. No.: WO2012/161404

PCT Pub. Date: Nov. 29, 2012

(65) Prior Publication Data

US 2014/0096342 A1 Apr. 10, 2014

(30) Foreign Application Priority Data

May 25, 2011 (KR) ..... 10-2011-0049797

(51) Int. Cl.
*E05F 5/02* (2006.01)
*E05F 5/00* (2006.01)
(Continued)

(52) U.S. Cl.
CPC ..... *E05F 5/00* (2013.01); *E05C 17/203* (2013.01); *E05D 11/10* (2013.01);
(Continued)

(58) Field of Classification Search
USPC ..... 16/49, 62, 69, 64, 82, 85, 86 C, 337, 16/354, 320, DIG. 10, DIG. 14; 296/146.11; 292/251.5, 275; 49/350, 49/358
See application file for complete search history.

(56) References Cited

U.S. PATENT DOCUMENTS 4,872,239 A * 10/1989 Ferguson et al. ..... 16/64
5,206,971 A * 5/1993 Schmelzer et al. ..... 16/62
(Continued)

FOREIGN PATENT DOCUMENTS

JP 2001-271845 10/2001
JP 2007-321365 12/2007
(Continued)

OTHER PUBLICATIONS

International Search Report and Written Opinion of the International Searching Authority issued in International Application No. PCT/KR2012/000916 on Sep. 7, 2012; 8 pages.
(Continued)

*Primary Examiner* — William Miller
(74) *Attorney, Agent, or Firm* — Fish & Richardson P.C.

(57) ABSTRACT

A device for checking the door of a vehicle that includes a fixing member that is attached to a vehicle body; a checker arm, an edge of which is hinge combined with the fixing member to be rotated and is located between a door and the vehicle body; and a door checker that is attached to the door to maintain the door in a stop-state at a position on a moving path of the door while sliding in a length direction of the checker arm by accommodating the checker arm therein, wherein the door checker includes: a housing in which an accommodation space is formed; a transformation element that is accommodated in the housing and transforms a straight line motion of the checker arm into a rotational motion by being engaged with the checker arm; a rotation element that is disposed within the housing, rotates by being engaged with the transformation element, and includes a friction plate; a fixing element that is fixedly installed in the housing and restricts the rotation member by attracting the friction plate of the rotation element by an electromagnetic force when an electrical signal is applied thereto; and a control element that controls ON and OFF of the electrical signal being applied to the fixing element.

5 Claims, 10 Drawing Sheets

(51) Int. Cl.

| | |
|---|---|
| ***E05C 17/20*** | (2006.01) |
| ***E05D 11/10*** | (2006.01) |
| ***E05C 17/00*** | (2006.01) |

(52) U.S. Cl.

CPC ..... *E05F 5/02* (2013.01);*E05C 17/003* (2013.01); *E05Y 2201/21* (2013.01); *E05Y 2201/462* (2013.01); *E05Y 2201/71* (2013.01); *E05Y 2900/531* (2013.01)

USPC ..... 16/82; 16/320; 296/146.11

(56) References Cited

U.S. PATENT DOCUMENTS

| | | | | |
|---|---|---|---|---|
| 5,346,272 | A * | 9/1994 | Priest et al. | 296/146.11 |
| 6,065,185 | A * | 5/2000 | Breed et al. | 16/86 C |
| 6,349,448 | B1 * | 2/2002 | Breed et al. | 16/82 |
| 6,681,444 | B2 * | 1/2004 | Breed et al. | 16/82 |
| 6,848,759 | B2 * | 2/2005 | Doornbos et al. | 312/319.1 |
| 6,928,694 | B2 * | 8/2005 | Breed et al. | 16/82 |
| 7,438,346 | B1 * | 10/2008 | Breed | 296/146.4 |
| 7,506,406 | B2 * | 3/2009 | Murayama et al. | 16/82 |
| 8,225,458 | B1 * | 7/2012 | Hoffberg | 16/49 |
| 2004/0055110 | A1 * | 3/2004 | Breed et al. | 16/82 |

FOREIGN PATENT DOCUMENTS

| | | |
|---|---|---|
| JP | 2008-008418 | 1/2008 |
| JP | 2008-223247 | 9/2008 |
| JP | 2008-280727 | 11/2008 |
| JP | 2011-58352 | 3/2011 |
| KR | 10-0534321 | 12/2005 |
| KR | 10-2009-0127239 | 12/2009 |

OTHER PUBLICATIONS

Japanese Non-Final Rejection, Japanese Patent Application No. 2014-511278, Oct. 28, 2014, 3 pages.

* cited by examiner

DEVICE FOR CHECKING THE DOOR OF A VEHICLE

CLAIM OF PRIORITY

This application is a U.S. National Stage of PCT/KR2012/000916 filed on Feb. 8, 2012, which claims priority to and incorporates by reference Korean Patent Application No. 10-2011-0049797 filed on May 25, 2011, both of which are hereby incorporated by reference.

TECHNICAL FIELD

The present invention relates to a device for checking the door of a vehicle, and more particularly, relates to a door checker that restricts opening and closing of a door according to a passenger.

BACKGROUND ART

Doors of a vehicle should stably maintain an open state when passengers get in or get out and when items are loaded or unloaded so that the getting in or getting out and the loading and unloading are smoothly performed. However, door hinges simply maintain a mounting state of the door and only allow the door to rotatably open and close, but cannot maintain the doors in an open state at a predetermined angle during an opening and closing operation.

Accordingly, on a vehicle, a door checker device is installed on a central region of a front side surface on an inner panel of the door so that the door can maintain a stop-state at two or three positions during the opening and closing operation of the door.

The door checker device generally includes: a fixing member that is attached to a vehicle body side; a checker arm that is hinge-combined with the fixing member to be rotated and is located between the door and the vehicle body; a door checker that is attached to the door and maintains the door in a stop-state at a position of a moving path of the door while moving along a length direction of the checker arm by accommodating the checker arm therein.

The door checker device also includes: a base bracket having a predetermined space therein; a slider that is accommodated in the base bracket; a spring located on a side of the slider; and a base cover that is combined with a side surface of the base bracket.

The device for checking the door of a vehicle of the related art having the above configuration is operated as follows.

When a door is opened, the position of the door is changed. The position of the door is changed according to the opening state of the door, and at this point, the door checker is also operated on the checker arm as the door is moved. For example, the door at an uppermost position is in a completely opened state, and thus, in this case, the door checker is pushed back to the final end point of the checker arm together with the door.

In this process, the checker arm moves along the inner space formed in the door checker, and the slider accommodated in the inner side of the door checker contacts a concaved groove of the checker arm when the checker arm passes through the inner space. Therefore, a buffer force is provided to the opening force of the door, that is, a function of the door checker is performed.

In the door checker device of the related art, an operation region of the door checker is limited to two or three steps. For example, when it is assumed that the door opening limited to step 1 is when the door is opened to 35 degrees and the door opening limited to step 2 is when the door is opened to 70 degrees, the door must be continuously opened and closed in a case where another vehicle is very closely parked beside the vehicle so the door cannot be opened more than 35 degrees and the door has to stop at a certain position.

Also, when the concaved groove is worn due to long term operation, the door checker may not properly operate, and thus, the door may be closed in a case where the door should be maintained in an open state, which may lead to an accident.

Also, recently, a technique has been developed whereby, when an object is located near a door, the opening of the door is limited by detecting the location of the object. However, the mechanical door checker of the related art cannot properly induce the stoppage of the opening door in an emergency situation.

DETAILED DESCRIPTION OF THE INVENTION

Technical Problem

The present invention provides a door checker device that allows an open state to be maintained at a desired angle, has durability, and allows rotation of a door to be suddenly stopped.

Technical Solution

According to an aspect of the present invention, there is provided a device for checking the door of a vehicle including: a fixing member that is attached to a vehicle body; a checker arm, an edge of which is hinge combined with the fixing member to be rotated and is located between a door and the vehicle body; and a door checker that is attached to the door to maintain the door in a stop-state at a position on a moving path of the door while sliding in a length direction of the checker arm by accommodating the checker arm in the door checker, wherein the door checker includes: a housing in which an accommodation space is formed; a transformation element that is accommodated in the housing and transforms a straight line motion of the checker arm to a rotational motion by being engaged with the checker arm; a rotation element that is disposed within the housing, rotates by being engaged with the transformation element, and includes a friction plate; a fixing element that is fixedly installed in the housing and restricts the rotation member by attracting the friction plate of the rotation element by an electromagnetic force when an electrical signal is applied thereto; and a restrict element that restricts ON and OFF of the electrical signal being applied to the fixing element.

The rotation member may fix a position of the door by being restricted rotation by the restriction of the fixing element when the transformation element rotates in one direction, and may allow the moving of the door even when the rotation element is repressed by the fixing element when the transformation element rotates in a direction opposite from the one direction.

The rotation element may include: a rotation member that rotatably engages with the transformation element; an elastic member that engages with the rotation member and is elastically deformed so that an outer diameter thereof increases or decreases according to the rotational direction of the rotation member; a cylindrical member that accommodates the elastic member therein and is friction-contacts the elastic member so the outer diameter of the elastic member is not expanded beyond a certain limit when the outer diameter of the elastic member is increased according to the rotation of the rotation member; and a friction plate that is fixedly combined with the cylindrical member and the rotation thereof is restricted while the friction plate friction-contacts the fixing element.

The elastic member may be a torsion spring, an edge of which protrudes inwards; and the rotation member may include a gear unit having gear teeth on an outer circumference thereof and an insertion stop unit that is inserted into the torsion spring and includes a slot into which the edge of the torsion spring is inserted.

The transformation element may include: a first gear member on which gear teeth are formed and that comprises a first stop unit that protrudes from a surface thereof; a second gear member on which gear teeth are formed, that comprises an insertion space on a surface thereof by protruding along an edge thereof, and comprises a second stop unit that protrudes from a surface of the insertion space, and an elastic insertion member that is inserted in the insertion space, transmits a rotation force of the first gear member to the second gear member by comprising slots into which the first stop unit and the second stop unit are inserted, and absorbs an impact that is applied to the first gear member since the elastic insertion member is formed of an elastically deformable material.

Advantageous Effects

The device for checking the door of a vehicle according to the current embodiment may fix a position of a door at a desired angle since a rotation element is restricted by a fixing element in response to an electrical signal supplied by a control element, and thus, the position of the door may be fixed.

Also, the position of the door may be restricted in an emergency situation such as when an object is present near the door, and thus, damage to the door may be prevented. Also, the device for checking the door of a vehicle according to the current embodiment may have a longer lifetime when compared to a device for checking the door of a vehicle of the related art, and accordingly, an overall durability of the device for checking the door of a vehicle may be increased.

BEST MODE

Figure 1:
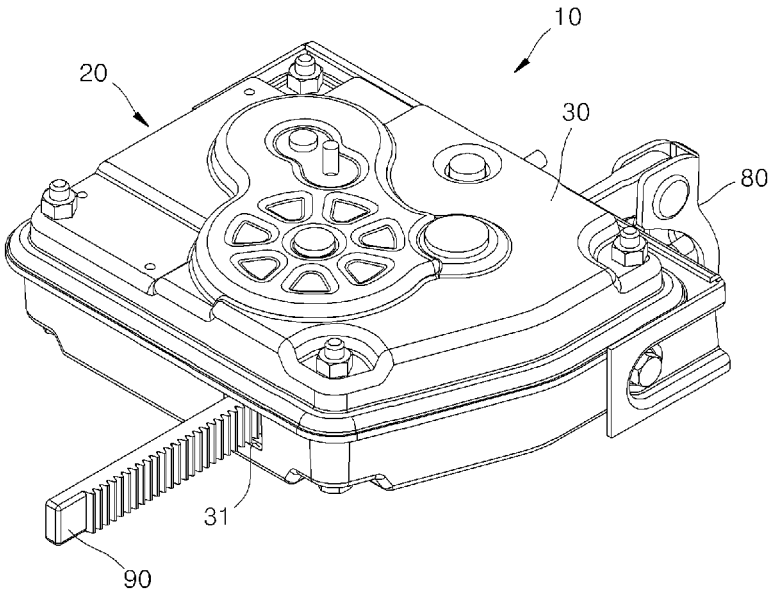
FIG. 1 is a perspective view of a device for checking the door of a vehicle according to an embodiment of the present invention.
Figure 2:
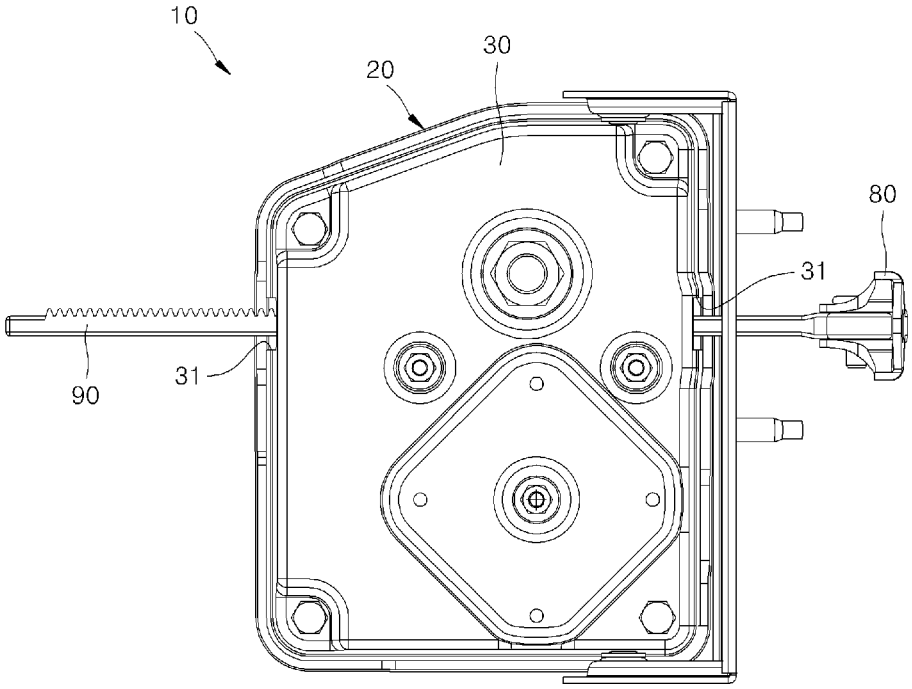
FIG. 2 is a rear view of the device for checking the door of a vehicle of FIG. 1.
Figure 3:
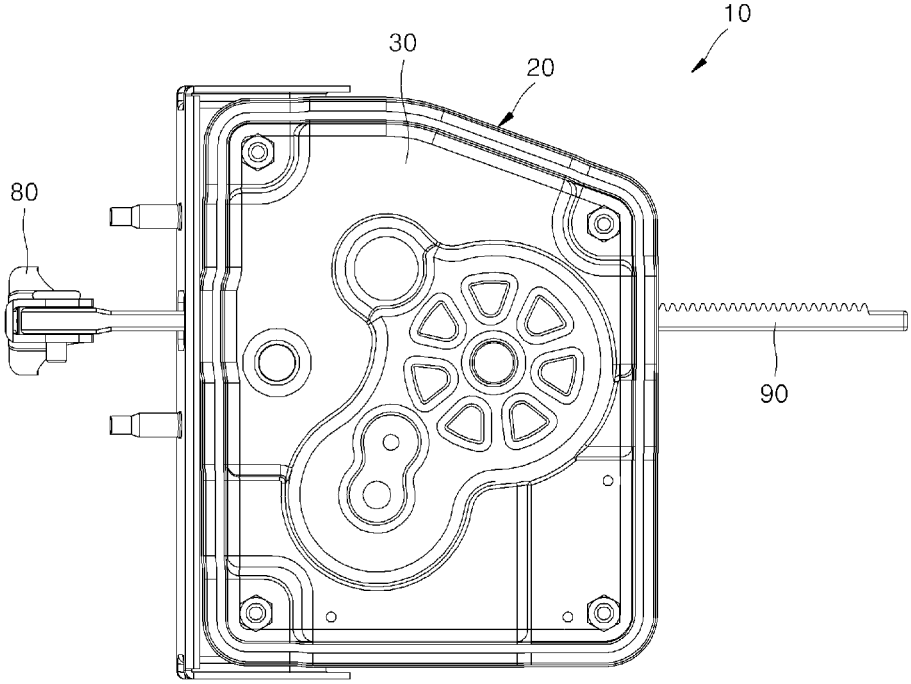
FIG. 3 is a plan view of the device for checking the door of a vehicle of FIG. 1.
Figure 4:
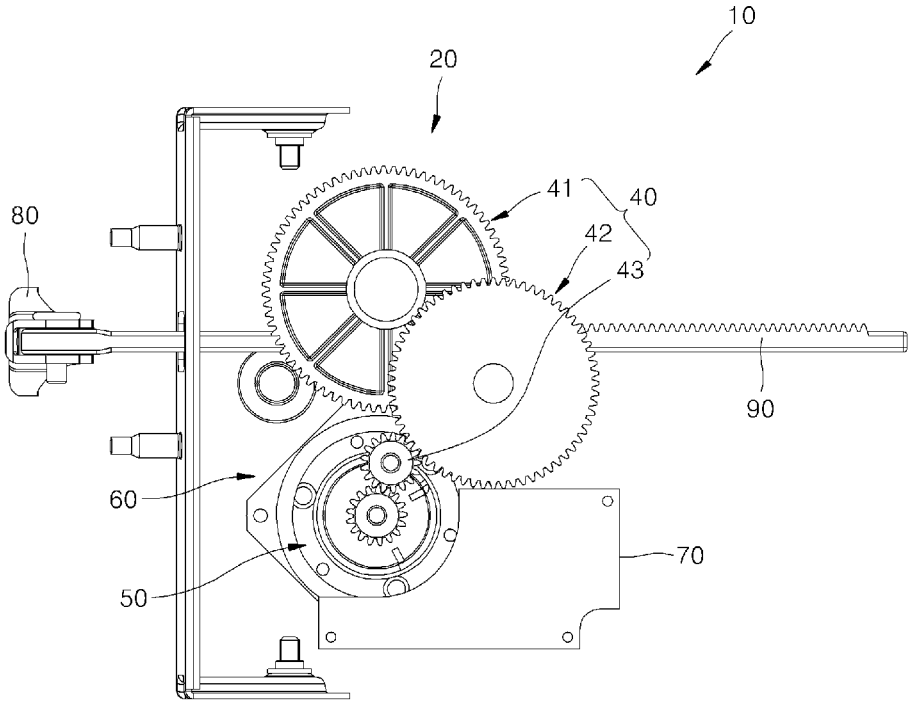
FIG. 4 is a top view of an inner side of the device for checking the door of a vehicle of FIG. 1.
Figure 5:
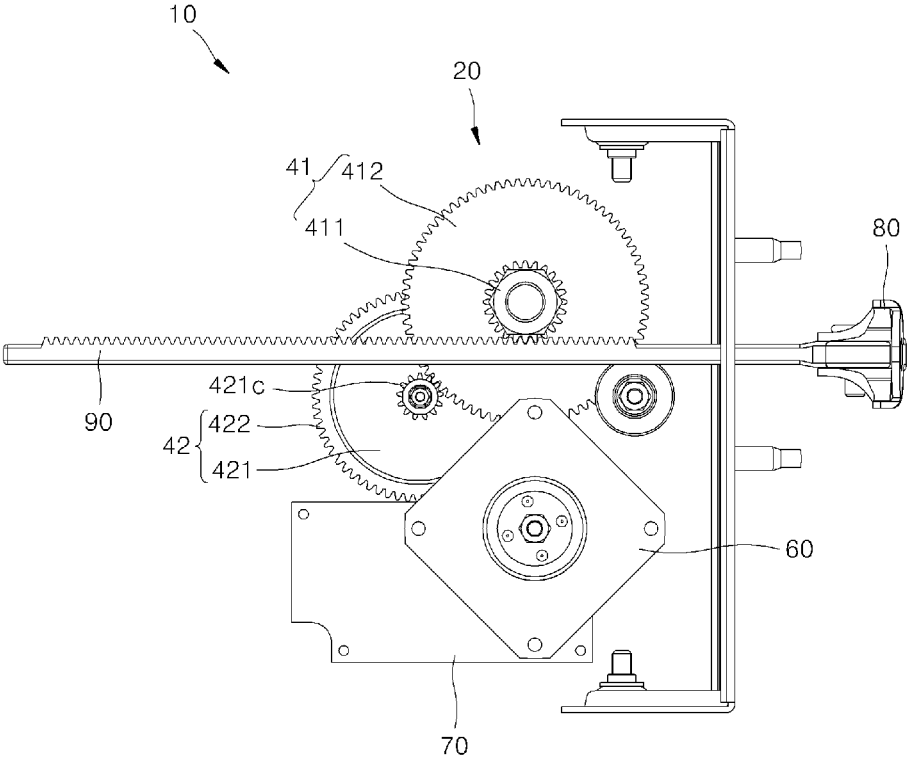
FIG. 5 is a bottom view of the inner side of the device for checking the door of a vehicle of FIG. 1.
Figure 6:
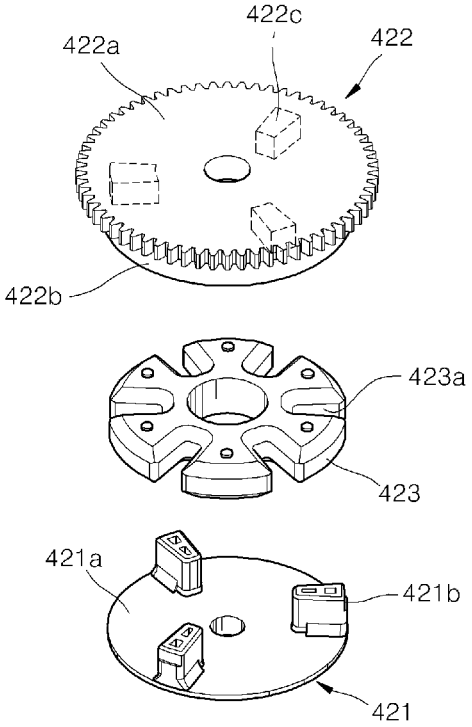
FIG. 6 is an exploded perspective view of a configuration of a transformation element of the device for checking the door of a vehicle of FIG. 1.

Hereafter, a device for checking the door of a vehicle according to an embodiment of the present invention will be described more fully with reference to the accompanying drawings, in which exemplary embodiments of the present invention are shown.

The device for checking the door of a vehicle 10 according to the current embodiment includes a fixing member 80 that is attached to the vehicle body, a checker arm 90 an edge 521 of the checker arm 90 is hinge combined with the fixing member 80 so that the checker arm 90 rotates, and that is located between the door and the vehicle body, and a door checker 20 that is attached to the door to maintain the door in a stop-state at a position of a moving path of the door while sliding along a length direction of the checker arm 90 by accommodating the checker arm 90 therein.

In the device for checking the door of a vehicle 10, the door checker 20 includes a housing 30, a transformation element 40, a rotation element 50, a fixing element 60, and a control element 70.

The housing 30 includes an accommodation space therein and an edge of the housing 30 is attached to the door. The housing 30 generally has a square box shape, and a through hole 31 is formed on a side of the housing 30 for the checker arm 90 to pass through and the through hole 31 is also formed on the other side of the housing 30 for the checker arm 90 to pass through. The checker arm 90 that enters through the through hole 31 may move in the housing 30 in a length direction of the housing 30. The checker arm 90 includes a plurality of gear teeth that are arranged in a length direction of the checker arm 90, and the gear teeth of the checker arm 90 engage with the transformation element 40.

The transformation element 40 is disposed in the housing 30 and is engaged with the checker arm 90 to transform a relative straight line motion with respect to the checker arm 90 into a rotation motion. The transformation element 40 is configured in a structure to rotate the rotation element 50 by transforming a straight line motion with respect to the checker arm 90 into a rotation motion. Also, the transformation element 40 includes a plurality of reducing gears, and thus performs as a reducer that reduces a rotation torque.

The transformation element 40 includes a first reducing gear 41, a second reducing gear 42, and a transmission gear 43.

The first reducing gear 41 includes a small gear 411 having a small diameter on a side thereof and a large gear 412 having a diameter greater than that of the small gear 411 on the other side thereof. The small gear 411 engages with the gear teeth of the checker arm 90 to transform a straight line motion of the checker arm 90 into a rotation motion.

The second reducing gear 42 includes a first gear member 421, a second gear member 422, and an elastic insertion member 423. The first gear member 421 includes a first stop unit 421*b* on which gear teeth are formed and protrude from a side thereof. More specifically, the first gear member 421 includes a first main body unit 421*a* having a circular disc shape, the first stop unit 421*b* that protrudes from a side surface of the first main body unit 421*a*, and a first gear 421*c* that protrudes from the other surface of the first main body unit 421*a* and has gear teeth on an outer circumference thereof.

The second gear member 422 includes a second main body unit 422*a* that has a circular disc shape and has a plurality of gear teeth on an outer circumference thereof, and a barrier rib 422*b* that protrudes along an edge is provided on a side surface thereof. An insertion space is provided by the barrier rib 422*b*. Second stop units 422*c* that protrude from the surface are formed in the insertion space.

The elastic insertion member 423 has generally a circular disc shape and has a sufficient size to be inserted into the insertion space of the second gear member 422. The elastic insertion member 423 includes slots 423*a* that are inserted into the insertion space of the second gear member 422, and into which the first stop unit 421*b* and the second stop unit 422*c* may be inserted. The slots 423*a* are formed to fit the shape of the first stop unit 421*b* and the second stop unit 422*c*, and thus, the first stop unit 421*b* and the second stop unit 422*c* may be tightly combined with respect to the slots 423*a*.

The elastic insertion member 423 is formed of a material that has high elasticity and easily absorbs impacts, such as rubber, and thus, absorbs impacts applied from the first gear member 421. For example, when there is a need to rapidly open a door or urgently stop opening of the door, the elastic insertion member 423 buffers the impact so the impact is not transmitted to the checker arm 90 or the rotation element 50 but is transmitted to other constituent elements.

The transmission gear 43 transmits a rotation force of the second gear member 422 to the rotation element 50, and includes gear teeth on an outer circumference thereof so that the transmission gear 43 engages with the second gear member 422 and the rotation element 50.

The rotation element 50 is disposed within the housing 30, is rotated by being engaged with the transformation element 40, and includes a friction plate 54.

When the transformation element 40 is rotated in a direction, the rotation of the rotation element 50 is restricted by the fixing element 60, and thus, the location of the door is fixed, and when the transformation element 40 is rotated in the other direction, the rotation element 50 may be rotated even when the rotation of the rotation element 50 is restricted by the fixing element 60, and thus, allows the door to be moved.

The rotation element 50 includes a rotation member 51, an elastic member 52, a cylinder member 53, and a friction member 54.

The rotation member 51 rotatably engages with the transformation element 40. The rotation member 51 includes a gear unit 511 that engages with the transmission gear 43 since it includes gear teeth on an outer circumference thereof, and an insertion stop unit 512 that is inserted into an inner side of a torsion spring, that is, the elastic member 52 described below, and includes a slot 512*a* into which an edge of the torsion spring is inserted. As the rotation member 51 is rotated due to the transmission gear 43, the torsion spring is wound in a direction or in another direction.

The elastic member 52 engages with the rotation member 51 and is elastically deformed such that an outer diameter thereof is increased or decreased according to the rotational direction of the rotation member 51. An edge 521 of the elastic member 52, which includes the torsion spring, protrudes inwards. Another edge 522 of the torsion spring is fixedly supported by a slot (not shown) formed in the cylinder member 53 described below.

The cylinder member 53 accommodates the elastic member 52 therein and prevents the diameter of the elastic member 52 from being expanded beyond a certain limit when the diameter of the elastic member 52 increases according to the rotation of the rotation member 51 while contacting the elastic member 52. The cylinder member 53 supports the other edge 522 of the torsion spring. The cylinder member 53 is configured such that the cylinder member 53 is rotated as one body with the rotation member 51 that engages with the elastic member 52 as the cylinder member 53 frictional contacts with the elastic member 52 while the elastic member 52 is expanded.

The cylinder member 53 may be formed as approximately a cylindrical shape using a metal material and an end of the cylindrical shape is closed.

The friction plate 54 is fixedly combined with the cylinder member 53 and the rotation thereof may be restricted while contacting the fixing element 60. The friction plate 54 is disposed facing the fixing element 60 which will be described below and may be disposed separately from the fixing element 60 with a minute gap therebetween. The configuration of the friction plate 54 is a well-known technique, and thus, a detailed description thereof will be omitted.

The fixing element 60 is fixedly installed within the housing 30, and, when an electrical signal is applied to the fixing element 60, may restrict the rotation member 51 by attracting the friction plate 54 of the rotation element 50 with an electromagnetic force. The fixing element 60 has a configuration of an electrical clutch, and thus, a description thereof will be omitted. When an electrical signal is applied to the fixing element 60, the fixing element 60 restricts the rotation of the friction plate 54 and the cylinder member 53 by electrically attracting the friction plate 54. When the electrical signal is removed, the fixing element 60 is separated from the friction plate 54 and the cylinder member 53, and thus, rotation of the friction plate 54 and the cylinder member 53 are allowed.

The control element 70 controls ON and OFF of the electrical signal being applied to the fixing element 60. The control element 70 is interlocked with a sensor for detecting an object around the door, and thus, when an object is detected near the door, the rotation of the door is restricted by applying an electrical signal to the fixing element 60. Accordingly, the control element 70 may prevent the opening of the door and may fix the position of the door.

Figure 7:
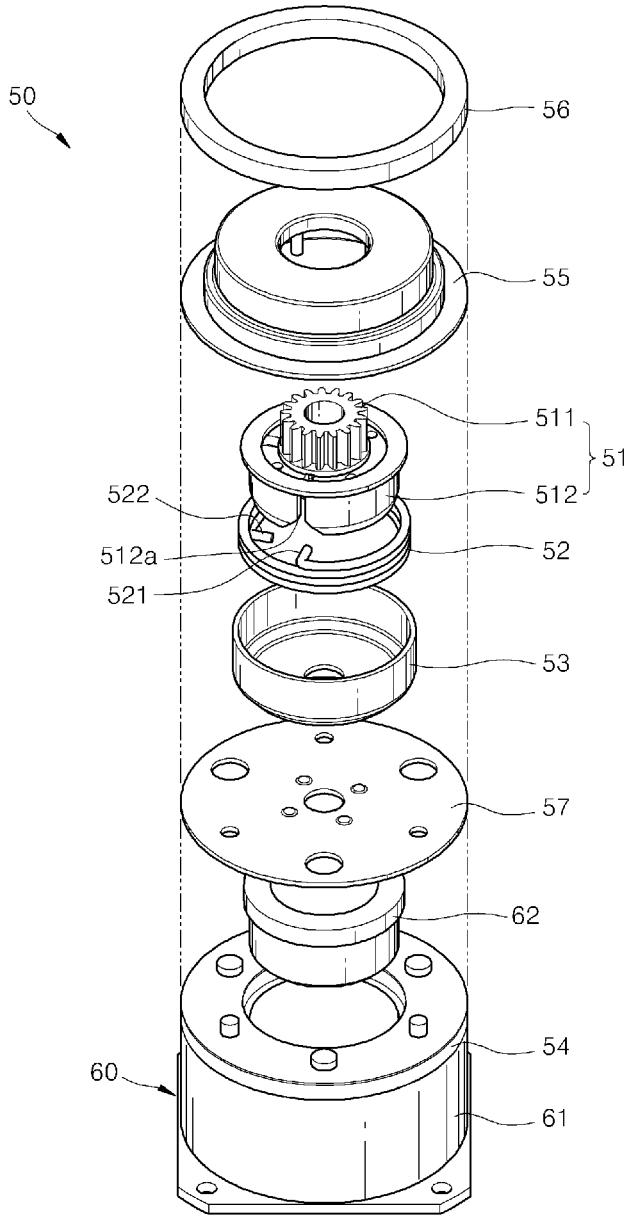
FIG. 7 is an exploded perspective view of rotation element of the device for checking the door of a vehicle of FIG. 1.
Figure 8:
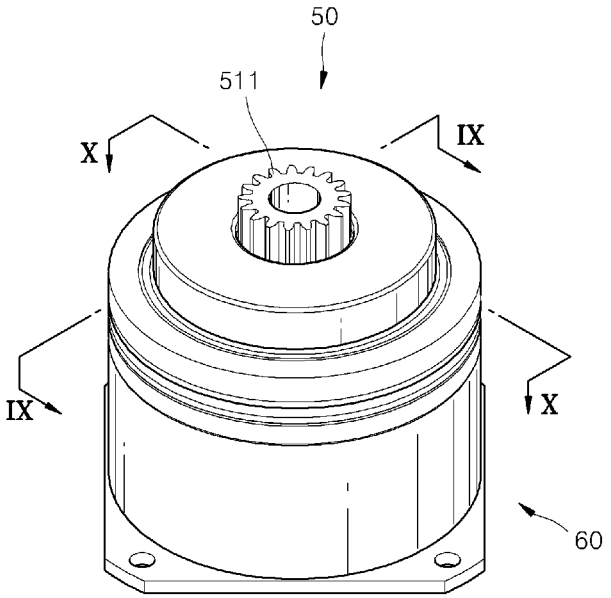
FIG. 8 is a perspective view of the combined rotation element of FIG. 7.
Figure 9:
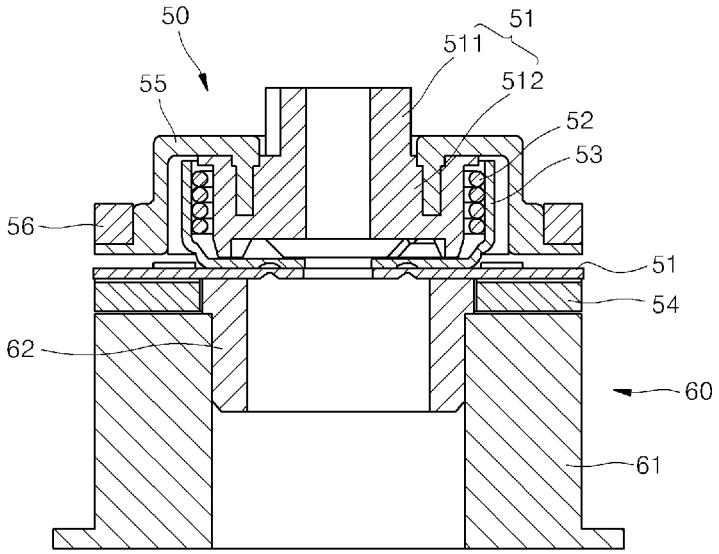
FIG. 9 is a cross-sectional view taken along a line IX-IX of FIG. 8.
Figure 10:
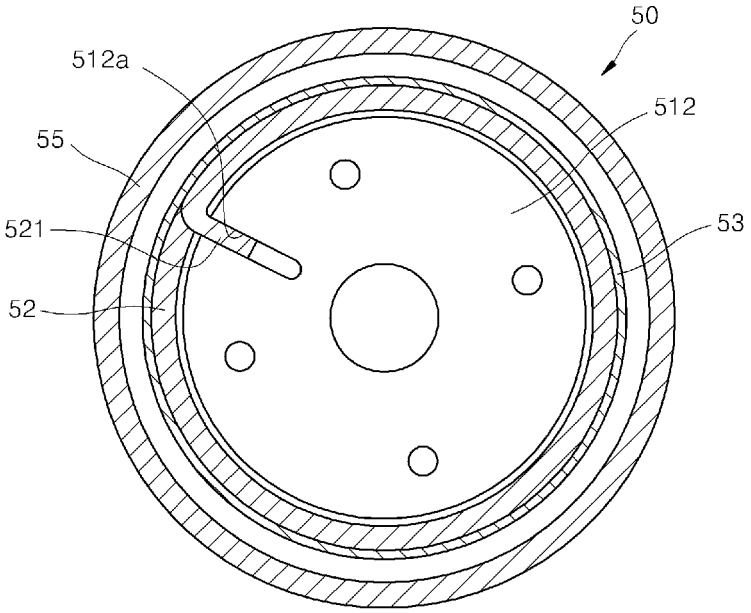
FIG. 10 is a cross-sectional view taken along a line X-X of FIG. 8.

Referring to FIG. 7, the rotation element 50 includes a cover 55, a ring 56, an elastic disc 57, a fixing element main body 61, and a magnet 62. The cover 55 forms an external shape of the rotation member 51 together with the ring 56 and the friction plate 54. The elastic disc 57 allows the friction plate 54 to be closely contacted or separated from the fixing element 60 by combining with the friction plate 54 and the cylinder member 53. That is, when there is no electromagnetic force generated from the fixing element 60, the friction plate 54 maintains a separated state from the fixing element 60, and when an electromagnetic force is generated from the fixing element 60, the friction plate 54 is elastically deformed so that the friction plate 54 closely contacts the fixing element 60. When the electromagnetic force is removed, an elastic restoration force is generated, and thus, the friction plate 54 may maintain the original state, that is, the separated state from the fixing element 60. The fixing element main body 61 constitutes an external shape of the fixing element 60, and the magnet 62 is disposed within the fixing element main body 61 to generate a magnetic force.

The device for checking the door of a vehicle 10 according to the current embodiment operates as follows.

First, when a door is opened, the checker arm 90 slidingly moves with respect to the door checker 20. When the checker arm 90 is slidingly moved, the transformation element 40 in the housing 30 transforms a straight line motion to a rotation motion. More specifically, the straight line motion is transformed to a rotation motion and transmitted through the first reducing gear 41, the second reducing gear 42, and the transmission gear 43. The rotational force is transmitted to the rotation element 50. More specifically, the transmission gear 43 rotates the rotation member 51. When the rotation member 51 rotates in a direction, the elastic member 52 that engages with the rotation member 51 is elastically deformed to increase an outer diameter thereof, and when the outer diameter is increased to a certain limit, the cylinder member 53 is rotated by friction-contacting an inner surface of the cylinder member 53. At this point, the friction plate 54 that is fixed on the cylinder member 53 is simultaneously rotated. At this point, the friction plate 54 maintains a predetermined gap from the fixing element 60. Accordingly, the friction plate 54 and the cylinder member 53 freely rotate. In this way, when a door is opened, the transformation element 40 and the cylinder member 53 rotate, and thus, the opening of the door is possible.

When there is an object that may collide with the door if the door opening is continued, the control element 70 that is connected to a predetermined detection sensor applies an electrical signal to the fixing element 60. When the electrical signal is applied to the fixing element 60, an electromagnetic force is generated from the fixing element 60, and the friction plate 54 that is separated by a predetermined gap is attached to the fixing element 60 due to the electromagnetic force. In this way, when the friction plate 54 is attached to the fixing element 60, rotation of the friction plate 54 is repressed, and accordingly, the motions of the cylinder member 53 that is fixed on the friction plate 54, the rotation member 51, the transformation element 40, and the checker arm 90 are stopped. Thus, the opening of the door is repressed.

Therefore, a further opening of the door is prevented, and accordingly, a collision with the object by the door is prevented.

The elastic insertion member 423 is provided in the second reducing gear 42 to absorb a sudden impact (an impact due to sudden stopping of the opening door) between the first gear member 421 and the second gear member 422, and thus, overall stability of the door checker 20 may be ensured.

When the door is closed, the movement of the door is possible although the friction plate 54 is attached to the fixing element 60. More specifically, although the rotation of the friction plate 54 and the cylinder member 53 is restricted since the friction plate 54 is attached to the fixing element 60 and the cylinder member 53 is attached to the friction plate 54, the rotation member 51 allows the movement of the transformation element 40 and the checker arm 90.

More specifically, when the door is closed, the rotation member 51 rotates in a direction B opposite to the direction of rotation when the door is opened. At this point, the torsion spring, that is, the elastic member 52, rotates in an inwardly winding direction. That is, the inward winding of the torsion spring is freely performed without being restricted by the cylinder member 53 when compared to the outward expanding of the torsion spring. Accordingly, the torsion spring may rotate the rotation member 51 without restricting the rotation of the rotation member 51 regardless of the rotation of the cylinder member 53. In this way, when the rotation member 51 is in a rotatable state, the rotation member 51 rotates together with the transformation element 40 and the checker arm 90, which are interlocked with the rotation member 51.

Unlike a device for checking the door of a vehicle of the related art in which a door position is fixed on a predetermined span, the device for checking the door of a vehicle 10 according to the current embodiment may stop the door opening at positions desired by the user by being combined with various detecting devices.

Especially, when the device for checking the door of a vehicle 10 is used together with an object detecting sensor, if an object is present near the door, and particularly, another vehicle is parked closely nearby, the door opening may be restricted at a predetermined span. Also, in this case, the closing of the door is possible, and thus, damage to the door may be prevented.

Also, since the position of the door is restricted by an electrical signal, the restriction of the door may be precisely performed when compared to mechanical restriction.

The device for checking the door of a vehicle 10 according to the current invention may be modified as follows.

In the embodiment described above, it is described that the device for checking the door of a vehicle 10 is restricted in a direction of the door and a motion is possible in an opposite direction, but the current embodiment is not limited thereto, that is, the door may be completely fixed on a predetermine span. In this case, an additional elastic member is removed from the rotation element, the rotation member and the cylinder member are fixedly combined with each other, or the rotation member may be directly fixedly combined with the friction plate. In this way, when there is no additional elastic member and when the rotation of the friction plate is repressed, the rotation of the rotation member in a one direction or in a direction opposite to the one direction may be repressed.

The invention claimed is:

1. A device for checking a door of a vehicle comprising:

a fixing member that is attached to a vehicle body;

a checker arm, an edge of which is hinge combined with the fixing member to be rotated and is located between the door and the vehicle body; and a door checker that is attached to the door to maintain the door in a stop-state at a position on a moving path of the door while sliding in a length direction of the checker arm by accommodating the checker arm in the door checker, wherein the door checker comprises:

a housing in which an accommodation space is formed;

a transformation element that is accommodated in the housing and transforms a straight line motion of the checker arm into a rotational motion by being engaged with the checker arm;

a rotation element that is disposed within the housing, rotates by being engaged with the transformation element, and includes a friction plate;

a fixing element that is fixedly installed in the housing and restricts the rotation element by attracting the friction plate of the rotation element by an electromagnetic force when an electrical signal is applied thereto; and a control element that controls ON and OFF of the electrical signal being applied to the fixing element.

2. The device for checking the door of a vehicle of claim 1, wherein the rotation element fixes a position of the door by restricting rotation by the of the fixing element when the transformation element rotates in one direction, and allows the moving of the door even when the rotation element is repressed by the fixing element when the transformation element rotates in a direction opposite from the one direction.

3. The device for checking the door of a vehicle of claim 2, wherein the rotation element comprises:

a rotation member that rotatably engages with the transformation element;

an elastic member that engages with the rotation member and is elastically deformed so that an outer diameter thereof increases or decreases according to the rotational direction of the rotation member;

a cylindrical member that accommodates the elastic member therein and frictionally contacts the elastic member so the outer diameter of the elastic member is not expanded beyond a certain limit when the outer diameter of the elastic member is increased according to the rotation of the rotation member; and the friction plate is fixedly combined with the cylindrical member and the rotation thereof is restricted while the friction plate frictionally contacts the fixing element.

4. The device for checking the door of a vehicle of claim 3, wherein the elastic member is a torsion spring, an edge of which protrudes inwards; and the rotation member comprises a gear unit having gear teeth on an outer circumference thereof and an insertion stop unit that is inserted into the torsion spring and comprises a slot into which the edge of the torsion spring is inserted.

5. The device for checking the door of a vehicle of claim 1, wherein the transformation element comprises:

a first gear member on which gear teeth are formed and that comprises a first stop unit that protrudes from a surface thereof;

a second gear member on which gear teeth are formed, that comprises an insertion space on a surface thereof by protruding along an edge thereof, and comprises a second stop unit that protrudes from a surface of the insertion space; and an elastic insertion member that is inserted in the insertion space, transmits a rotation force of the first gear member to the second gear member by comprising slots into which the first stop unit and the second stop unit are inserted, and absorbs an impact that is applied to the first gear member since the elastic insertion member is formed of an elastically deformable material.

* * * * *